US011680566B2

(12) United States Patent
Erisgen et al.

(10) Patent No.: US 11,680,566 B2
(45) Date of Patent: Jun. 20, 2023

(54) ROTARY VANE PUMP

(71) Applicant: Pinnacle Climate Technologies, Eden Prairie, MN (US)

(72) Inventors: Sukru Erisgen, Eden Prairie, MN (US); Chris Kwok, Eden Prairie, MN (US)

(73) Assignee: Pinnacle Climate Technologies, Inc., Eden Prairie, MN (US)

( * ) Notice: Subject to any disclaimer, the term of this patent is extended or adjusted under 35 U.S.C. 154(b) by 110 days.

(21) Appl. No.: 17/026,803

(22) Filed: Sep. 21, 2020

(65) Prior Publication Data

US 2021/0396139 A1 Dec. 23, 2021

Related U.S. Application Data

(60) Provisional application No. 63/042,245, filed on Jun. 22, 2020.

(51) Int. Cl.

| | |
|---|---|
| ***F01C 21/00*** | (2006.01) |
| ***F03C 2/00*** | (2006.01) |
| ***F03C 4/00*** | (2006.01) |
| ***F04C 18/344*** | (2006.01) |
| ***F01C 21/08*** | (2006.01) |
| ***F04C 2/344*** | (2006.01) |

(52) U.S. Cl.

CPC ..... *F04C 18/344* (2013.01); *F01C 21/0809* (2013.01); *F04C 2/344* (2013.01); *F04C 2230/91* (2013.01); *F04C 2230/92* (2013.01); *F04C 2240/20* (2013.01); *F05C 2203/0808* (2013.01); *F05C 2253/20* (2013.01)

(58) Field of Classification Search

CPC ..... F01C 21/0809; F01C 21/04; F04C 2/344; F04C 18/344; F04C 2230/91; F04C 2230/92; F04C 2240/20; F05C 2203/0808; F05C 2225/00; F05C 2251/14; F05C 2253/12; F05C 2253/20

See application file for complete search history.

(56) References Cited

U.S. PATENT DOCUMENTS 2,540,714 A * 2/1951 Curtis ..... F04C 29/021 418/87
3,191,852 A * 6/1965 Kaatz et al. ..... F01C 21/0809 418/152
3,256,003 A * 6/1966 Briggs ..... F23C 99/00 126/110 B
3,398,884 A * 8/1968 Kaatz ..... F01C 21/0809 418/152
3,706,446 A * 12/1972 Briggs ..... F24H 3/04 432/224

(Continued)

FOREIGN PATENT DOCUMENTS

JP 2016173052 A * 9/2016

*Primary Examiner* — Theresa Trieu
(74) *Attorney, Agent, or Firm* — Merchant & Gould P.C.

(57) ABSTRACT

A rotary vane pump including a housing, and a motor. The motor includes a shaft which is coupled to a rotor. The rotor defines a plurality of slots. A plurality of free moving vanes are disposed within the slots. In one example, the rotor is formed from a first material and the plurality of vanes are formed from the first material and impregnated with a second material. The first material can be a carbon material. The second material can be a resin material, an antimony material, a copper material, or a silver material.

20 Claims, 4 Drawing Sheets

(56) References Cited

U.S. PATENT DOCUMENTS

| | | | | |
|---|---|---|---|---|
| 4,081,238 | A * | 3/1978 | Briggs | F24C 15/18 432/222 |
| 4,443,187 | A * | 4/1984 | Shaftner | F24H 3/04 432/222 |
| 4,548,678 | A * | 10/1985 | Laflin | F01C 21/0809 418/152 |
| 5,181,844 | A | 1/1993 | Bishop et al. | |
| 6,364,646 | B1 | 4/2002 | Kirtley et al. | |
| 2014/0030130 | A1* | 1/2014 | Labbett | F01C 21/0863 418/259 |
| 2018/0372095 | A1* | 12/2018 | Lo Biundo | F04C 2/3442 |
| 2021/0071909 | A1* | 3/2021 | Erisgen | F24H 3/0417 |

* cited by examiner

ROTARY VANE PUMP

CROSS-REFERENCE TO A RELATED APPLICATION

This application claims priority to U.S. Provisional Application Ser. No. 63/042,245, filed Jun. 22, 2020. The complete disclosure of U.S. Application Ser. No. 63/042,245 is incorporated herein by reference.

TECHNICAL FIELD

The present disclosure relates generally to rotary vane air pumps, for example, those used in conjunction with portable heaters.

BACKGROUND

Self-lubricating rotary vane air pumps are commonly used in many industries throughout the world. Most self-lubricating rotary vane air pumps use a graphite rotor with slots and a plurality of vanes slidably received in the slots. Such pumps typically have a housing and at least two plates to internally contain the rotor and vanes. In one particular application, sliding rotary vane air pumps are used in kerosene/diesel fired air heaters (i.e. KFA heaters). In such an application, rotary vane air pumps are used to draw fuel out of a KFA heater fuel tank. In typical configurations, the fuel tank is attached to bottom of kerosene/diesel heater and the burner is located above the fuel tank. Air pump discharge pressure can be adjusted for various altitude and heating capacity.

Conventional rotors and vanes are often made from compressed graphite powder in various methods to provide desired tensile strength. By nature, self-lubricating graphite rotary vane pumps are self-destructive as the graphite within the rotor and vanes deposits on surfaces to provide lubrication as the pump operates. Over time, the graphite slowly erodes to provide such lubrication. Such erosion causes carbon dust to enter air stream. Accordingly, an air filter must be used to filter out carbon dust from entering into fuel system, more importantly fuel spray nozzle. Also, compressed carbon rotor and vanes are very susceptible to grease and excess moisture. As such, when components are exposed to oil and moisture, residue accumulates on the surfaces (i.e. components start to gunk up) and can cause pump to cease.

Some approaches involving the use of laminated or impregnated materials (e.g. PTFE (polytetrafluoroethylene), PEEK [polyether ether ketone], etc.) to reduce friction and wear have been developed to address these concerns, such as those described in U.S. Pat. Nos. 6,364,646 and 5,181,844. However, such approaches do not solve all problems associated with wear, thermal and friction issues. In the case of some PEEK and other options, excess heat may actually cause these parts to prematurely fail.

SUMMARY

In one aspect this disclosure relates to a rotary vane pump. The rotary vane pump includes a body housing, the body housing includes a cover on a first end. The cover includes an inlet and an outlet. In another aspect the rotary vane pump includes a shaft which rotates about a rotational axis the shaft is coupled to a motor to rotate the shaft. Another aspect of the rotary vane pump includes a rotor which attaches to the shaft in order for the rotor to rotate about the rotational axis. The rotor is made from a carbon material and defines a plurality of slots. The rotary vane pump also includes a plurality of vanes which fit into the slots. The vanes are free moving and slideable from the rotor out to a pump body secured in the housing body by a plurality of fasteners. The fasteners are secured to a motor housing. The plurality of vanes are made from a carbon material which has been impregnated with a material.

In another aspect, this disclosure relates to a method of manufacturing a carbon vane for a rotary vane pump. To manufacture the carbon vane the vane is impregnated with a 5-10% by weight resin, 5-20% by weight antimony (such as FH42A), 5-15% by weight copper, 5-10% by weight silver and 10% by weight (other metals).

In one example, a rotary vane pump includes a motor having a motor shaft;

a pump body mounted to the motor, a rotor coupled to the motor shaft and disposed within the pump body, and a plurality of vanes slidably received into slots defined within the rotor, wherein, the rotor is formed from a first material and the plurality of vanes are formed from the first material and impregnated with a second material.

In some examples, the first material is a carbon material.

In some examples, the first material is a graphite material.

In some examples, the second material is a resin material.

In some examples, the second material is a metal material.

In some examples, the second material is one of antimony, copper, and silver.

In some examples, the first material is a graphite and the second material is a resin.

In some examples, the first material is 95% weight and the second material is 5% weight.

In some examples, the pump body is made from stainless steel.

In some examples, the pump further includes a filter for filtering air received by the pump.

In some examples, the first material has an initial pre-impregnated porosity of at least 5% by volume and is impregnated with the second material to have a post-impregnated porosity of less than 5% by volume.

In some examples, the pre-impregnated porosity is between about 5% and 10% by volume and the post-impregnated porosity is up to about 5% by volume.

In some examples, the pre-impregnated porosity is about 10% by volume and the post-impregnated porosity is about 1% by volume.

In one example, a rotary vane pump includes a rotor defining a plurality of slots and a plurality of vanes slidably received into the slots, wherein, the rotor is formed from a first material and the plurality of vanes are formed from the first material and impregnated with a second material.

In some examples, the first material is a carbon material.

In some examples, the first material is a graphite material.

In some examples, the second material is a resin material.

In some examples, the second material is a metal material.

In some examples, the second material is one of antimony, copper, and silver.

In some examples, the first material is a graphite and the second material is a resin.

In some examples, the first material is 95% weight and the second material is 5% weight.

In some examples, the first material has an initial pre-impregnated porosity of at least 5% by volume and is impregnated with the second material to have a post-impregnated porosity of less than 5% by volume.

In some examples, the pre-impregnated porosity is between about 5% and 10% by volume and the post-impregnated porosity is up to about 5% by volume.

In some examples, the pre-impregnated porosity is about 10% by volume and the post-impregnated porosity is about 1% by volume.

A rotary vane pump can include a rotor defining a plurality of slots and a plurality of vanes slidably received into the slots. In one aspect, the plurality of vanes are formed from a first material that has been impregnated with a second material and the rotor is formed from the first material and is free of the second material.

A variety of additional aspects will be set forth in the description that follows. The aspects relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Whenever possible, the same reference numbers will be used throughout the drawings to refer to the same or similar parts.

Figure 1:
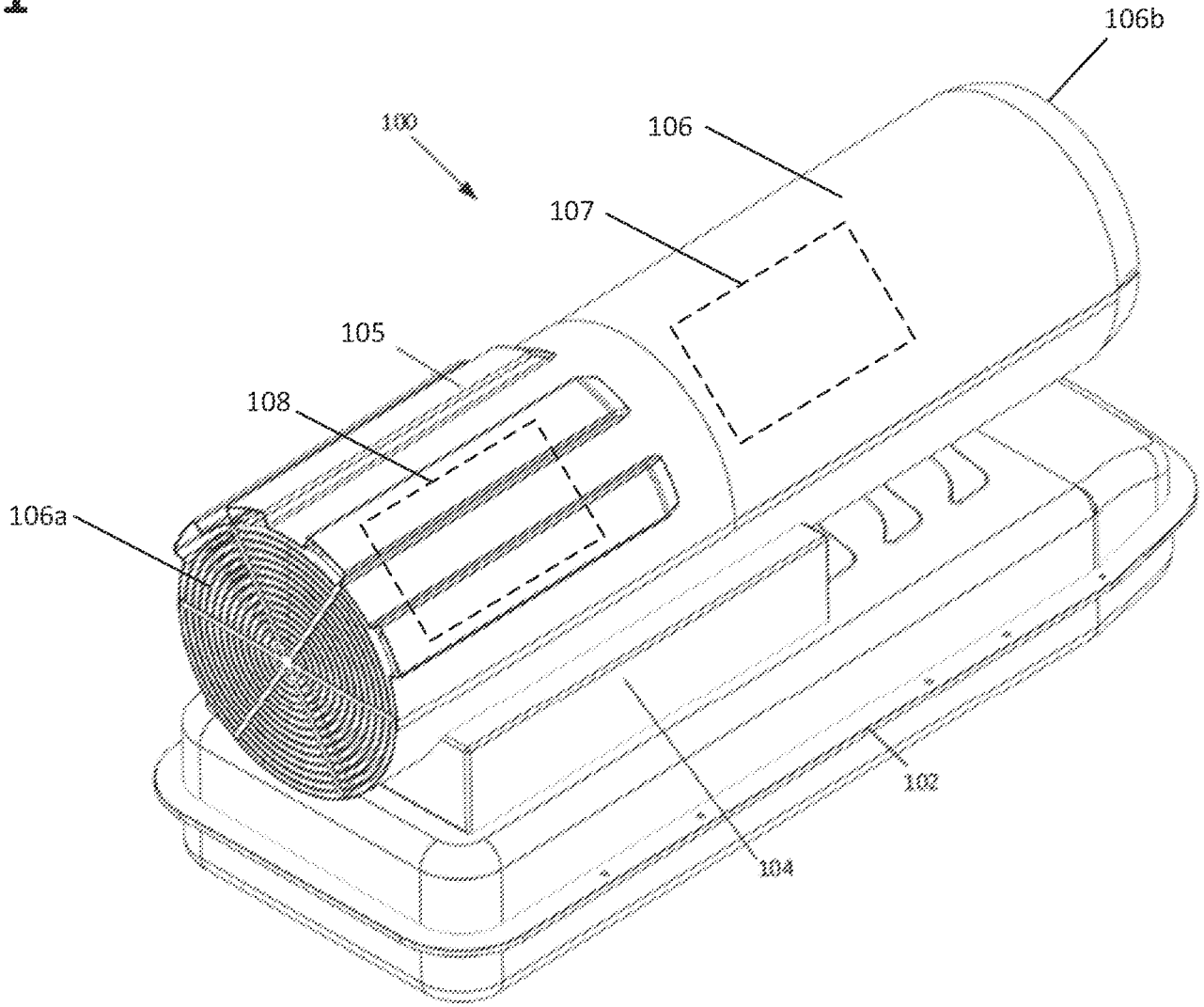
FIG. 1 is a perspective view of a first example of a portable heater including a blower-pump assembly with a rotary vane pump, the portable heater having features in accordance with the present disclosure.

FIG. 1 shows an example heater 100. The heater 100 shown is a forced air heater 100, such as kerosene/diesel fired air heater (KFA heater) 100. In one aspect, the heater 100 includes a fuel tank 102, a heater frame 104, and a heater assembly 105. As shown, the heater assembly 105 includes a tubular housing 106 defining an interior volume extending between a first end 106*a* and a second end 106*b*. Disposed within the interior volume of the housing 106, is a burner assembly 107 and a blower-pump assembly 108. In one aspect, the fuel tank 102 typically is configured to store a liquid fuel such as kerosene or diesel as fuel used by a burner assembly 107 within the housing 106 to heat the air passing through the housing 106. The blower-pump assembly 108 performs two functions. First, the blower-pump assembly 108 provides compressed air, such that fuel can be delivered from the fuel tank 102 to the burner assembly 107, for example via a Venturi effect. Second, the blower-pump assembly 108 forces air through the housing 106 such that it can be heated by the burner assembly 107. Accordingly, in operation, relatively cool air is drawn into the first end 106*a*, heated within the housing 106, and discharged as heated air out of the second end 106*b*.

Figure 2:
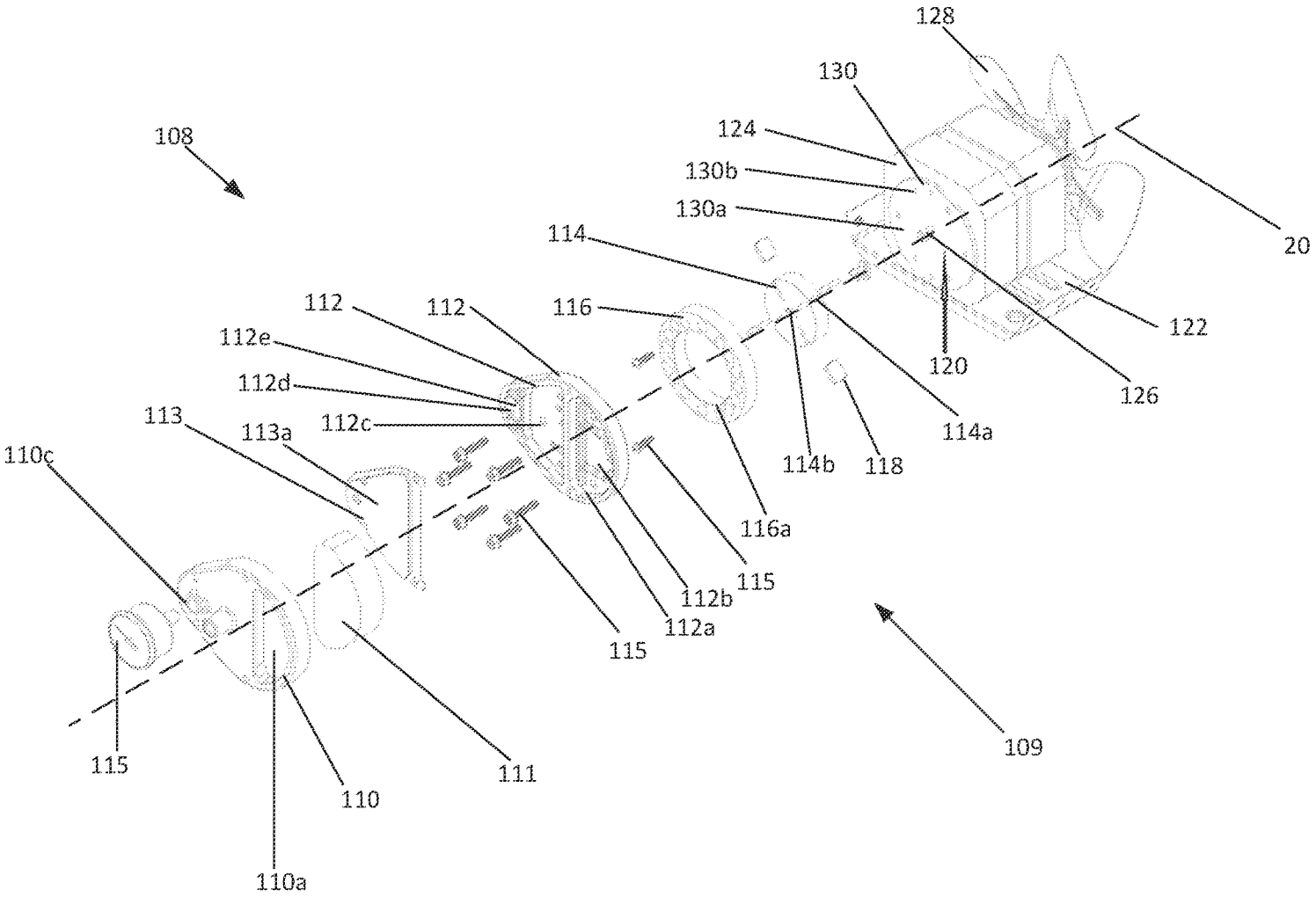
FIG. 2 is an exploded view of the blower-pump assembly and the rotary vane pump of the portable heater of FIG. 1.

With reference to FIG. 2, the blower-pump assembly 108 of the heater 100 is shown in further detail. In one aspect, the blower-pump 108 includes a pump assembly 109 and a motor assembly 120. The motor assembly 120 is shown as including a support frame 122 that supports an electric motor 124. The support frame 122 mounts to the interior of the housing 106 such that the electric motor 124 is supported within the housing 106. In one aspect, the electric motor 124 includes a drive shaft 126 that extends through front and back ends of the motor 124. On one end, a fan 128 is mounted to the drive shaft 126. Accordingly, when the motor 124 is activated, the fan 128 is rotated by the drive shaft 126 to draw air through the housing 106. The motor assembly 120 is further shown as including a bearing or face plate 130 that acts as an interface surface for the pump assembly 109, as described later. The bearing or face plate 130 can include openings, such that fasteners 115 can be used to secure the bearing or face plate 130 to the housing of the electric motor 124 and to secure the pump assembly 109 to the bearing or face plate 130 and/or the electric motor 124.

Figure 3:
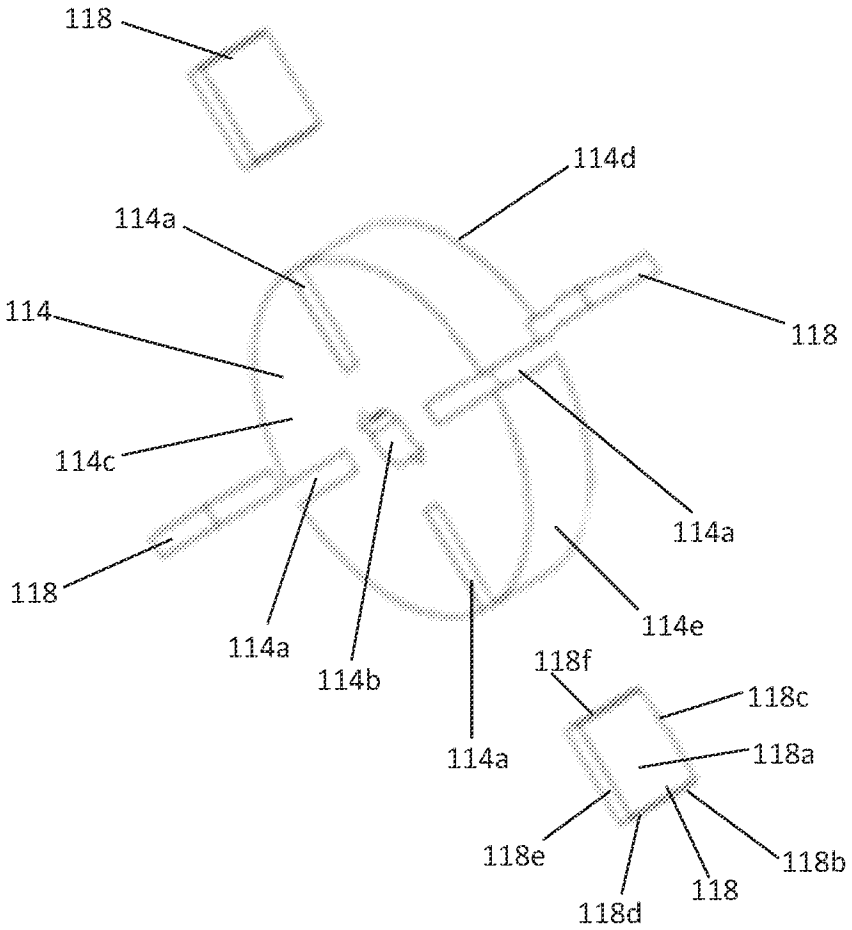
FIG. 3 is an exploded view of a portion of FIG. 2 showing only the rotor and vanes of the rotary vane pump.
Figure 4:
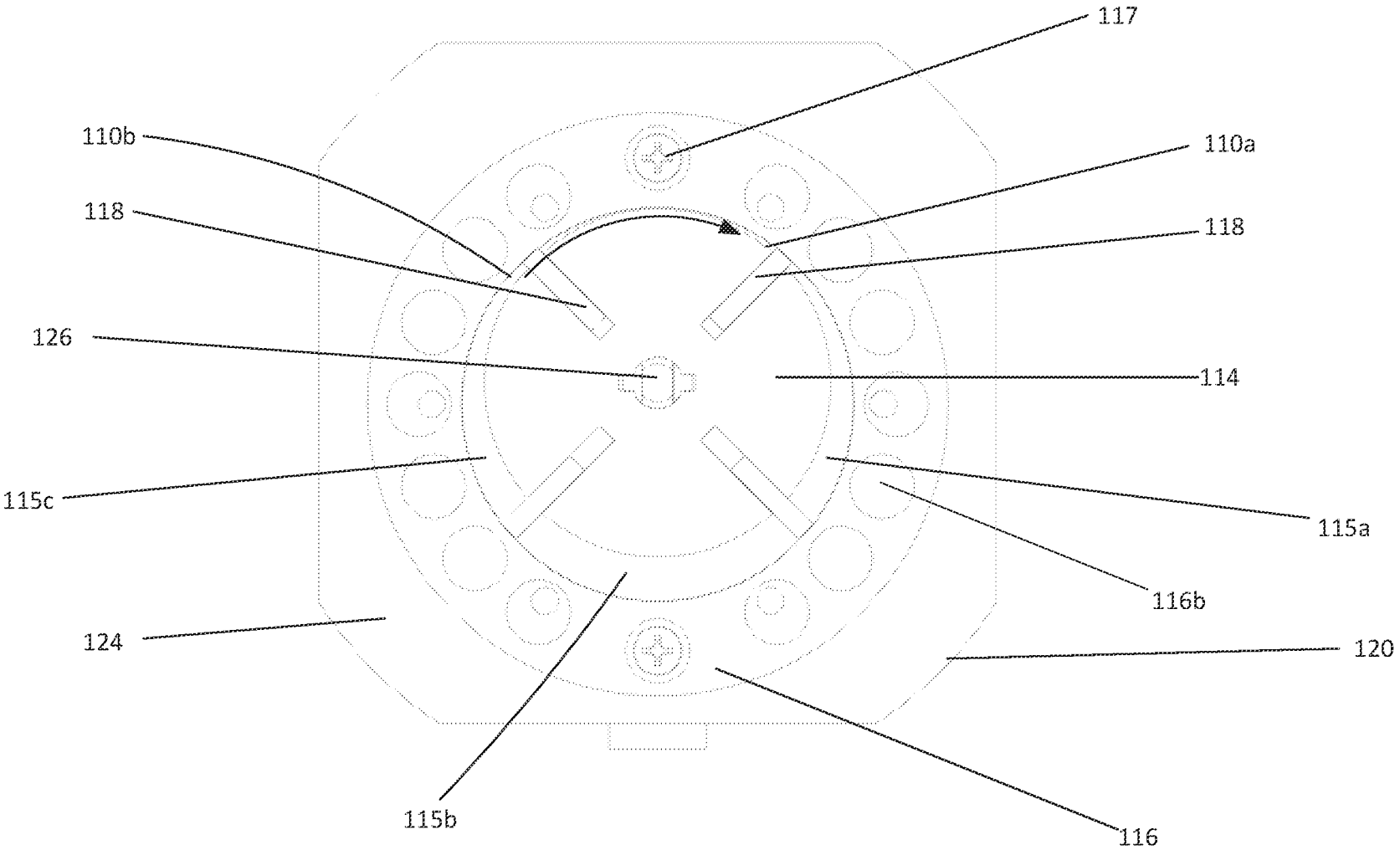
FIG. 4 is a cross-sectional front view of the rotary vane pump shown in FIG. 2.

With reference to FIGS. 2 to 4, the pump assembly 109 is shown as being a rotary vane type pump. As constructed, the pump assembly 109 includes: a first housing part 110, a filter 111, a second housing part 112, an outlet chamber cover 113, a rotor 114, various fasteners 115, a pump body 116, a pressure gauge 117, a plurality of vanes 118, and a motor 120.

In one aspect, the first housing part 110 of the rotary vane pump assembly109 includes an inlet opening 110*a* and an outlet opening 110*b*. The inlet opening 110*a* defines a pathway for atmospheric air to enter the pump assembly 109. The outlet opening 110*b* is configured as a port such that pressure gauge 117 can be installed to indicate the compressed air pressure. In one aspect, the first and second housing parts 110, 112 are secured together to form an interior volume, for example with fasteners 115. The filter 111 is disposed within the interior volume such that atmospheric air entering through the inlet opening 110*a* is filtered before being compressed. In one aspect, the second housing part 112 includes an open frame or support structure 112*a* for receiving the filter 111 and an opening 112*b* through which filtered air can pass to the pump body 116. The filter 111 prevents foreign particles from entering the interior 116*a* of the rotary vane pump 109 which can cause damage. In one aspect, the second housing part 112 also defines an outlet volume or chamber 112*c* with one or more apertures for receiving compressed air from the pump body 116. The second housing part 112 further defines a second outlet chamber 112*d* having an outlet 112*e* for connection to a hose or conduit that is in turn connected to the burner assembly 107. An air discharge cover 113 is shown as being provided over the outlet chambers 112*c*, 112*e* such that the chambers 112*c*, 112*d* are placed in fluid communication with each other. In one aspect, the discharge cover 113 can include a filter 113*a* such that air leaving the chamber 112*c* is filtered before entering the chamber 112*d*.

In one aspect, the rotor 114, vanes 118, and pump body 116 collectively define a pump, wherein the rotor 114 eccentrically rotates within the pump body 116 such that the vanes 118 slide in and out of the pump body 116 to alternately receive, compress, and discharge air.

As presented, the rotor 114 defines a shaft opening 114*b*. The shaft opening 114*b* allows for the shaft 126 of the motor 120 to extend through the rotor 114. In one aspect, the shaft opening 114*b* is offset from the center of the rotor 114 such that the rotor 114 rotates in an eccentric fashion upon activation of the motor 120. The rotor 114 additionally includes a plurality of slots 114*a* which are circumferentially spaced. The slots 114*a* slidably receive the vanes 118, each of which is shaped as a prismatic body with first and second faces 118*a*, 118*b* extending between sidewalls 118*c*, 118*d*, 118*e*, 118*f*. In this particular example, there are four different slots 114*a* in the rotor 114 with four vanes 118, one for each slot. The slots 114*a* and vanes 118 are equally spaced around the diameter of the rotor 114 and are positioned in a straight configuration. It is within the scope of the present disclosure for the vanes 118 to be configured in different orientations, spaced differently about the rotor 114 and for there to be more or less than four vanes 118.

The rotor 114 typically has a circular cross-section. In one aspect, the slots 114*a* and central opening 114*b* extend between first and second faces 114*c*, 114*d* of the rotor 114. The slots 114*b* additionally extend radially outward to a circumferential sidewall 114*e*. In operation, the rotor 114 rotates about an axis 20. The axis 20 extends through the shaft opening 114*b* and through the shaft 126 of the motor 120. As the rotor 114 rotates, the face 114*c* makes contact with an opposing face of the second housing part 112, the face 114*d* makes contact with a face 130*a* of a plate 130 mounted to the motor 120, and the circumferential sidewall 114*e* makes contact with the inner surface of the pump body 116.

Referring to FIG. 4, a front cross-sectional view is presented showing the rotary vane pump 109 with the cover 110, rotor cover 112, inlet filter 111 and outlet cover 113 and filter 113*a* removed. As presented, the pump body 116 has a cylindrical body defining an interior opening or volume 116*a*. The pump body 116 includes a plurality of openings 116*b* circumferentially spaced around the area between the opening 116*a* and an outer wall 116*c* of the pump body 116. Some of the openings 116*b* function as inlet ports for allowing atmospheric air to enter the opening 116*a* while some of the openings 116*b* function as outlet ports for allowing compressed air to exit the opening 116*a*. As shown, the pump body 116 is fastened to the motor 120 by fasteners 115. The pump body 116 is typically made of stainless steel.

In operation, the rotor 114 rotates with the shaft 126. The vanes 118 move freely in the slots 114*a* and rotate with the rotor 114. As the vanes 118 rotate they extend outwardly to engage with the pump body 116 with centrifugal force. As the rotor 114 is eccentrically rotating within the opening 116*a*, the volume defined between adjacent vanes 118 continually changes such that when the volume increases air is drawn into the volume and such that when the volume decreases, air is compressed and ultimately discharged as compressed air.

In one aspect, the rotor 114 and vanes 118 can be formed, at least partially, from a carbon material, such as graphite. With such a material, the rotor 114 and vanes 118 self-lubricate, meaning the composition facilitates fairly low frictional and wear coefficients such that the wear of the rotor 114 self-dispenses to lubricate the system. As the rotor 114 is self-lubricating, carbon particles can exit through the outlet 112*d*. The air discharge filter 113*a* is used to prevent them from fully exiting the rotary vane pump 109 and interfering with operation.

In one aspect, the rotor 114 and vanes 118 can be formed from a first material and impregnated with a second material to extend the operating life and operational performance of the pump. In some examples, a process is used in which the first material is first used to wholly form the vanes themselves or to form a larger body, such as a sheet, from which the vanes 118 can then be cut or otherwise defined. With such an approach, the wholly formed vanes or sheet formed by the first material has a resulting porosity in which the pores of the first material are then partially or wholly impregnated with the second material, for example by a vacuum process. In one example, the first material is a carbon graphite material and the second material is one or more of a resin, antimony, copper, silver or various grades of other metals. In examples, the vanes 118 are impregnated to have 5% by weight resin, 5% by weight antimony, 5% by weight copper, or 4% by weight silver. Other examples include 10% weight various grades of other materials, metals, etc. In examples, the first material has an initial bulk density of about −108 pounds per cubic foot (Lbs/Ft$^3$) and a final bulk density, after impregnation with the second material of about 110 Lbs/Ft$^3$. In examples, the first material has a porosity of about 10% and is impregnated with the second material to have a porosity less than 5%, more preferably less than 3%, and even more preferably at 1% or below.

In a particular example, the first material is carbon graphite and the second material is resin. The carbon graphite can have an initial bulk density of about 108 Lbs/Ft$^3$, a scleroscope hardness of about 80, and an initial volume porosity of about 10%. The carbon graphite can be impregnated with resin, for example by a vacuum process, such that the vane 118 has a final bulk density of about 110 Lbs/Ft$^3$, a final hardness of 95, and a volume porosity of about 1%. With such a configuration, the compressive strength increases from 25,000 pounds per square inch (psi) for the unimpregnated carbon graphite to 32,000 psi after the impregnation with resin, a 28% increase.

In one example, the rotor 114 is formed only of a first material while the vanes 118 are formed of the first and second material. In one example, the vanes 118 include a second material that is not present in the rotor 114. In one example, the rotor 114 is formed of only graphite while the vanes 118 are formed from a graphite material and one or more of a resin, antimony, copper, and a silver material. It has been learned that such a configuration, wherein the rotor 114 is not impregnated with a second material and the vanes are impregnated with the second material, sufficient lubrication is provided while still significantly increasing the service life of the rotor and vane assembly. With such a configuration, the rotor 114 is able to provide sufficient lubrication for the entire assembly while the impregnated vanes 118 are provided with increased durability. Such an approach is particularly advantageous as the vanes in a rotary vane pump are commonly subjected to more wear than the rotor. A similar effect can be found by impregnating the rotor 114 with the second material, but at a level below the impregnation of the vanes 118 with the second material.

As a point of reference, typical prior art rotor and vane configurations require frequent replacement, typically after around 500 hours of use. However, when the vanes 118 are impregnated with the resin, antimony, copper or the other metals that have a degree of self-lubricity described above it has been found that the life can be extended. In some examples the life cycle has been extended to 2000 to 3000 hours using resin and antimony to impregnate the vanes 118. In another aspect, when the vanes 118 are impregnated, they can also have thermal properties which allow for better heat dissipation in comparison to a vane 118 which is only made from carbon or impregnated with other materials. In yet another aspect, when the vanes 118 are impregnated, the vanes 118 can help with friction losses. Testing conducted on the disclosed inventions proved that, when the vanes 118 are impregnated with one of these materials, significant improvement in air pump performance also resulted. Further, a pump with said vanes does not start deteriorating immediately and the deterioration curve of the vanes 118 becomes very flat for much longer. This also has the further benefit of reducing carbon build up the air discharge filter 113*a*, thus extending the service life of the filter 113*a*.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. A rotary vane pump comprising:

a) a motor having a motor shaft;

b) a pump body mounted to the motor;

c) a rotor coupled to the motor shaft and disposed within the pump body; and d) a plurality of vanes slidably received into slots defined within the rotor;

e) wherein, the rotor and the plurality of vanes are formed from at least a first material, wherein, for the plurality of vanes, the first material is impregnated with a second material such that the second material is 5% by weight.

2. The rotary vane pump of claim 1, wherein the first material is a carbon material.

3. The rotary vane pump of claim 2, wherein the first material is a graphite material.

4. The rotary vane pump of claim 1, wherein the second material is a resin material.

5. The rotary vane pump of claim 1, wherein the second material is a metal material.

6. The rotary vane pump of claim 5, wherein the second material is one of antimony, copper, and silver.

7. The rotary vane pump of claim 1, wherein the first material is a graphite and the second material is a resin.

8. The rotary vane pump of claim 1, wherein the first material is 95% by weight.

9. The rotary vane pump of claim 1, wherein the pump body is made from stainless steel.

10. The rotary vane pump of claim 1, further comprising a filter for filtering air received by the rotary vane pump.

11. The rotary vane pump of claim 1, further including a fan mounted to the motor shaft.

12. A rotary vane pump comprising:

a motor having a motor shaft;

a pump body mounted to the motor;

a rotor coupled to the motor shaft and disposed within the pump body; and a plurality of vanes slidably received into slots defined within the rotor;

wherein, one or both of the rotor and the plurality of vanes is formed from a first material and impregnated with a second material;

wherein the first material associated with one or both of the rotor and the plurality of vanes has an initial pre-impregnated porosity of at least 5% by volume and is impregnated with the second material to have a post-impregnated porosity of less than 5% by volume.

13. The rotary vane pump of claim 12, wherein the pre-impregnated porosity is between 5% and 10% by volume and the post-impregnated porosity is up to 5% by volume.

14. The rotary vane pump of claim 13, wherein the pre-impregnated porosity is 10% by volume and the post-impregnated porosity is 1% by volume.

15. A rotary vane pump comprising:

a rotor defining a plurality of slots; and a plurality of vanes slidably received into the slots;

wherein, the plurality of vanes and the rotor are both formed from a carbon material that has been impregnated with a resin material such that the resin material is 5% by weight and the carbon material is up to 95% by weight.

16. The rotary vane pump of claim 15, wherein the carbon material has an initial pre-impregnated porosity of at least 5% by volume and is impregnated with the resin material to have a post-impregnated porosity of less than 5% by volume.

17. The rotary vane pump of claim 16, wherein the pre-impregnated porosity is between about 5% and 10% by volume and the post-impregnated porosity is up to about 5% by volume.

18. The rotary vane pump of claim 17, wherein the pre-impregnated porosity is about 10% by volume and the post-impregnated porosity is about 1% by volume.

19. The rotary vane pump of claim 15, wherein the plurality of vanes includes 10% by weight a material other than carbon and resin. material to have a post-impregnated porosity of less than 5% by volume.

20.

A portable heater comprising;

a) a housing;

b) a fuel tank supported by the housing;

c) a burner assembly located within the housing; and d) a rotary vane pump being located within the housing and arranged to deliver fuel from the fuel tank to the burner assembly, wherein the rotary vane pump comprising:

a motor having a motor shaft;

a pump body mounted to the motor;

a rotor coupled to the motor shaft and disposed within the pump body; and plurality of vanes slidably received into slots defined within the rotor;

wherein, the rotor and the plurality of vanes are formed from at least a first material, wherein, for the plurality of vanes, the first material is impregnated with a second material such that the second material is 5% by weight.

* * * * *